United States Patent [19]

Saito et al.

[11] Patent Number: 4,854,041

[45] Date of Patent: Aug. 8, 1989

[54] METHOD OF MANUFACTURING A SWITCH BASE

[75] Inventors: Akira Saito; Teisuke Nukada; Michio Ito, all of Tokyo, Japan

[73] Assignee: Nihon Kaiheiki Industrial Co., Ltd., Tokyo, Japan

[21] Appl. No.: 156,860

[22] Filed: Feb. 17, 1988

[30] Foreign Application Priority Data

Sep. 1, 1987 [JP] Japan ..... 62-216420

[51] Int. Cl.[4] ..... H01H 11/00; H01H 65/00

[52] U.S. Cl. ..... 29/884; 29/876; 29/883; 29/622

[58] Field of Search ..... 29/566.2, 566.3, 622, 29/874, 876, 882, 883, 884

[56] References Cited

U.S. PATENT DOCUMENTS 4,075,442 2/1978 Fukuda et al. .
4,284,314 8/1981 Lesyk ..... 29/884 X
4,628,597 12/1986 Meehan et al. ..... 29/884 X

*Primary Examiner*—Howard N. Goldberg

*Assistant Examiner*—Taylor J. Ross

*Attorney, Agent, or Firm*—Armstrong, Nikaido, Marmelstein, Kubovcik & Murray

[57] ABSTRACT

In a method of manufacturing a switch base according to the invention, blanked members are prepared, each having a common strip formed at a lower part thereof, a plurality of finger-shaped pieces extending from the common strip, fixed contact portions formed on distal end portions of respective ones of the finger-shaped pieces, and terminal portions situated between respective ones of the fixed contact portions and the common strip. Next, indentically shaped blanked members are superimposed in such a manner that the fixed contact portions thereof are spaced away from one another, and the blanked members are assembled together with the fixed contact portions being arrayed in a plurality of rows and the terminal portions being arrayed in a single row. Thereafter, a resin is molded between the fixed contact portions and the terminal portions to form a base, and the common strips are cut away to manufacture a switch base.

4 Claims, 2 Drawing Sheets

METHOD OF MANUFACTURING A SWITCH BASE

BACKGROUND OF THE INVENTION

This invention relates to a method of manufacturing a switch base constituting a miniature switch. The switch base has fixed contact portions arranged in a plurality of rows on the top side thereof, and terminal portions, which are integrated with the fixed contact portions, arranged in a single row on the bottom side thereof.

In a conventional method of manufacturing a switch base constituting a miniature switch, members produced by a blanking process are used. Each blanked member is formed to include three finger-shaped pieces and a common strip interconnecting the finger-shaped pieces. Each finger-shaped piece is formed beforehand to include a fixed contact portion and a terminal portion.

The blanked members are inserted in a mold and the common strips of the blanked members are held in the mold. Thereafter, portions situated between the fixed contact portions and terminal portions are enveloped by an insulative resin to form a base, after which the common strips of the blanked members are cut off to provide a switch base in which the fixed contact portions and terminal portions are arranged.

One problem encountered in the conventional manufacturing method is that since two of the blanked members are used, it is necessary to employ a number of molds.

Another problem is that when the switch base is mounted on a printed circuit board, namely when the switch is attached to a printed circuit board longitudinally or transversely, it is required that the terminal portions be bent row by row, so that the bending work involves an expenditure of great labor. In addition, the fact that the switch occupies a large area of the printed circuit board is an impediment to reducing the size of the device using the switch.

SUMMARY OF THE INVENTION

An object of the present invention is to provide a switch base manufacturing method through which a switch base can be manufactured in a small number of steps without requiring use of a number of molds.

Another object of the present invention is to provide a switch base manufacturing method through which a switch base can easily be mounted on a printed circuit board without the switch occupying a large area of the printed circuit board.

In a preferred embodiment of the present invention, blanked members are prepared, each having a common strip formed at a lower part thereof, a plurality of finger-shaped pieces extending from the common strip and equidistantly arrayed in a single row, fixed contact portions formed on distal end portions of respective ones of the finger-shaped pieces and spaced apart in a direction perpendicular to the direction in which the plurality of finger-shaped pieces are arrayed, and terminal portions situated between respective ones of the fixed contact portions and the common strip.

The common strips of identically shaped blanked members are superimposed in such a manner that the fixed contact portions are spaced away from one another, and are assembled together with the fixed contact portions being arrayed equidistantly in a plurality of rows and the terminal portions being arrayed equidistantly in a single row, after which a resin is molded between the fixed contact portions and the terminal portions to form a base. Lastly, the common strips of the blanked members are cut away to manufacture a switch base.

In accordance with the present invention, a switch base in which there are formed plural rows of equidistant fixed contact portions and a single row of equidistant terminal portions can be manufactured very easily merely by superimposing the common strips of blanked pieces having an identical shape and loading them into a mold. Operating efficiency is enhanced and the structure is simplified. In addition, since the common strips are superimposed and integrally formed in such a manner that the terminal portions are equidistantly spaced, the dimensional precision of the molding operation can be improved. Furthermore, by arraying the terminal portions of the switch base in a single row, the arranging of the terminal portions and the mounting of the switch on a printed circuit board are greatly facilitated.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail with reference to the drawings.

Figure 1:
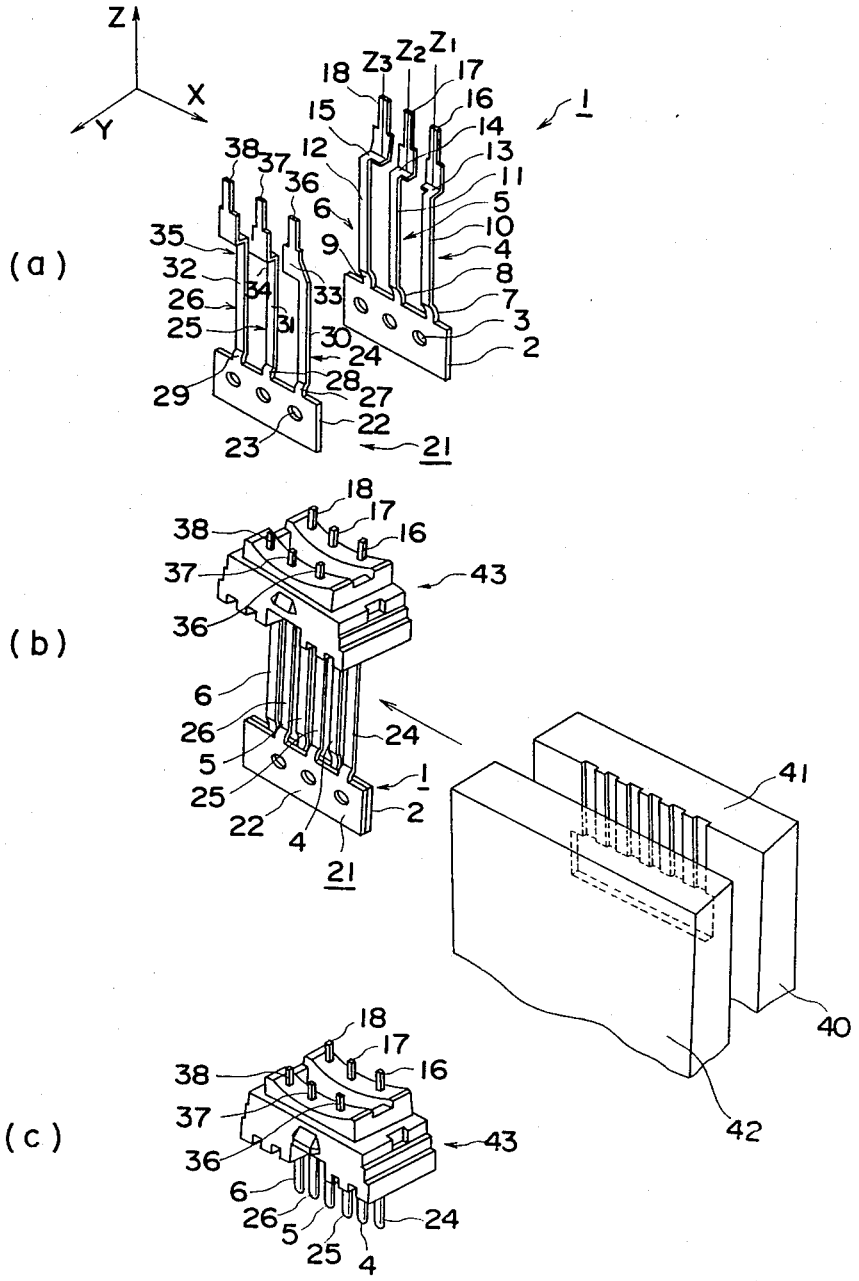
FIG. 1(*a*)–(*c*) are process views illustrating an embodiment of a method of manufacturing a switch base according to the present invention.
Figure 2:
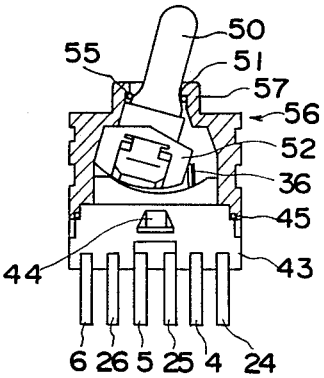
FIG. 2 is a sectional view illustrating a miniature switch using the switch base manufactured in accordance with the manufacturing method of the present invention.
Figure 3:
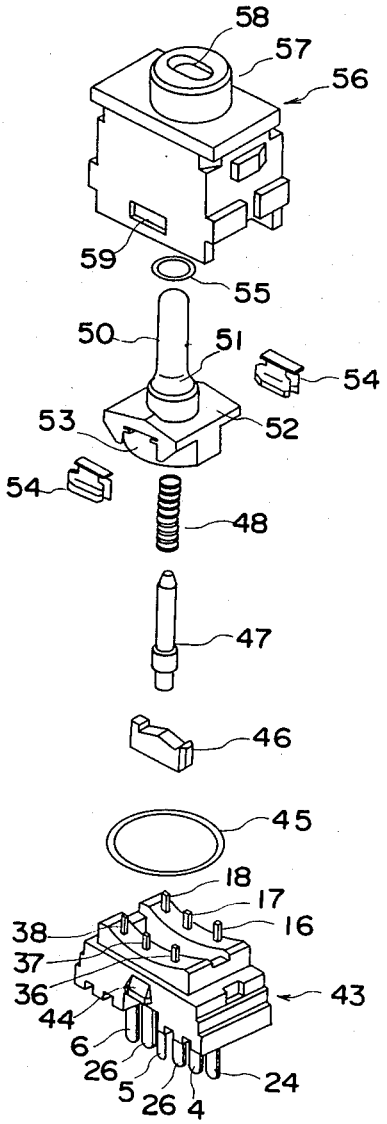
FIG. 3 exploded perspective view illustrating a miniature switch using the switch base manufactured in accordance with the manufacturing method of the present invention.

In FIGS. 1 through 3, numeral 1 denotes a first blanked member having a common strip 2, holes 3 formed in the common strip 2 for positioning when finger-pieces are formed, and three finger-shaped pieces 4, 5 and 6 extending from the common strip 2. The finger-shaped pieces 4, 5 and 6 are respectively formed to include first bent portions 7, 8 and 9 bent from the common strip 2 along the y axis in order to array terminal portions in a single row, terminal portions 10, 11 and 12, second bent portions 13, 14 and 15 bent along the -y axis in order to be spaced away from fixed contact portions of a second blanked member that is to oppose the first blanked member 1, and fixed contact portions 16, 17 and 18 formed on the distal ends of the respective bent portions.

Numeral 21 denotes a second blanked member which has a shape exactly the same as that of the first blanked member 1. As shown in (a) of FIG. 1, the first and second blanked members 1, 21 are faced toward each other in such a manner that the second blanked member 21 is turned away from the first blanked member 1.

Accordingly, the second blanked member 21 has a common strip 22, holes 23 for positioning when forming finger-shaped pieces formed on the common strip 22, and three finger-shaped pieces 24, 25 and 26 extending from the common strip 22. The finger-shaped pieces 24, 25 and 26 are respectively formed to include first bent portions 27, 28 and 29 bent from the common strip 22 along the -y axis in order to array terminal portions in a single row, terminal portions 30, 31 and 32, second bent portions 33, 34 and 35 bent along the y axis in order to be spaced away from the fixed contact portions of a first blanked member 1 that is to oppose the second blanked member 21, and fixed contact portions 36, 37 and 38 formed on the distal ends of the respective bent portions.

When the first blanked member 1 and second blanked member 21 are assembled, the fixed contact portions 16 and 36, 17 and 37, 18 and 38 of the first and second blanked members 1, 21 are brought into accurate opposition with each other and the terminal portions are arranged into a single row.

In order to obtain a fixed spacing between terminal portions 33 and 10, 10 and 31, 31 and 11, 11 and 32 and 32 and 12, the terminal portion 10 is offset along the x axis with respect to a center line $Z_1$ of fixed contact portion 16, the terminal portion 11 is offset along the -x axis with respect to a center line $Z_2$ of fixed contact portion 17, and the terminal portion 12 is offset widely along the -x axis with respect to a center line $Z_3$ of fixed contact portion 18.

Similarly, in the second blanked member 21, the terminal portion 30 is offset widely along the x axis with respect to a center line $Z_1$ of fixed contact portion 36, the terminal portion 31 is offset along the x axis with respect to a center line $Z_2$ of fixed contact portion 37, and the terminal portion 32 is offset along the -x axis with respect to a center line $Z_3$ of fixed contact portion 38.

The first blanked member 1 and second blanked member 21 are then faced toward each other in the manner shown in (a) of FIG. 1.

Next, the common strips 2, 22 are overlapped, the common strips 2, 22 and terminal portions 10, 11, 12, 30, 31, 32 are inserted into the groove 41 of a bottom mold 40, and in this state the first and second blanked members 1, 21 are subjected to pressing by a bottom mold 42. Next, in order to mold an insulative synthetic resin in the portions situated between the fixed contact portions and between the terminal portions, a top mold (not shown) is set and a base 43 is injection molded, as shown in (b) of FIG. 1.

Next, as shown in (c) of FIG. 1, the common strips 2, 22 of the first and second blanked members 1, 21 are cut off. Thus, there is obtained a switch base having fixed contact portions arrayed in two rows and terminal portions arrayed in one row.

A miniature switch using the switch base set forth above will now be described.

FIG. 2 is a sectional view of such a miniature switch, and FIG. 3 is an exploded perspective view of the miniature illustrated in FIG. 2.

In FIGS. 2 and 3, projections 44 are provided on the front and back sides of the switch base 43, and an O-ring is provided between the switch base 43 and the main body of the switch in order to provide waterproof and dustproof properties. A detent 46 is provided between the fixed contact portions arrayed in two rows. A plunger 47 is fitted into a hole (not shown), which is formed in the central portion of an actuator block 52 at the lower part thereof, via a coil spring 48. The lower end of the plunger 47 abuts against the detent 46. A toggle lever 50 has an enlarged portion 51 at which the toggle lever 50 is connected to the actuator block 52. The front and back of the actuator block 52 are formed to include a recess 53 which receives a clip-shaped movable contactor 54. An O-ring 55 is securely fitted onto the outer periphery on the upper part of the enlarged portion 51 of toggle lever 50 and is used to assure a waterproof and dustproof condition. The switch has a main body 56 the upper part of which is formed to include a sleeve 57. The upper end of the sleeve 57 is formed to include an opening 58 through which the toggle lever 50 is passed. The projections 44 on the switch base 43 are fitted into holes 59 formed in the front and back sides of the switch body 56.

In the above-described embodiment, the fixed contact portions are arranged in two rows. However, the number of rows can be increased, and the invention can be practiced even if three, four or more rows are provided.

It should be noted that the present invention is not limited to the foregoing embodiments but can be modified in various ways based on the gist of the invention without departing from the scope of the claims.

In accordance with the present invention as described in detail hereinabove, the following advantages are obtained:

(1) A switch base in which there are formed plural rows of equidistant fixed contact portions and a single row of equidistant terminal portions can be manufactured very easily merely by superimposing the common strips of blanked pieces having an identical shape and loading them into a mold. This enhances operating efficiency.

(2) The structure is simplified. In addition, since the common strips are superimposed and integrally formed in such a manner that the terminal portions are equidistantly spaced, the dimensional precision of the molding operation can be improved.

(3) By arraying the terminal portions of the switch base in a single row, the arranging of the terminal portions and the mounting of the switch on a printed circuit board are greatly facilitated.

What we claim is:

1. A method of manufacturing a switch base having fixed contact portions and terminal portions integrally formed from a metal plate, the fixed contact portions and the terminal portions projecting from top and bottom sides, respectively, of the switch base, said method comprising the steps of:

(a) preparing blanked members each having a common strip formed at a lower part thereof, a plurality of finger-shaped pieces extending from said common strip and equidistantly arrayed in a single row, fixed contact portions formed on distal end portions of respective ones of said finger-shaped pieces and spaced apart in a direction perpendicular to the direction in which the plurality of finger-shaped pieces are arrayed, and terminal portions situated between respective ones of said fixed contact portions and said common strip;

(b) superimposing said common strips of identically shaped blanked members in such a manner that the fixed contact portions of said blanked members are spaced away from one another, and assembling said superimposed common strips together with said fixed contact portions being arrayed equidistantly in a plurality of rows and said terminal portions being arrayed equidistantly in a single row;

(c) forming a base by molding a resin between said fixed contact portions and said terminal portions of said blanked members; and (d) cutting away the common strips of said blanked members.

2. The method according to claim 1, wherein two common strips of said blanked members are superimposed and said fixed contact portions are arrayed symmetrically in two rows.

3. The method according to claim 1 further including the step of bending said finger-shaped pieces to form first and second bent portions.

4. The method according to claim 3 wherein said first bent portion is bent in order to arrange said terminal portions in said single row and said second bent portion is bent in order that said fixed contact portions are spaced away from one another.

* * * * *